United States Patent [19]

Dimitriu

[11] Patent Number: 4,465,280

[45] Date of Patent: Aug. 14, 1984

[54] MAZE BOARD GAME

[76] Inventor: Dan Dimitriu, 2228 Sixth Ave., Fargo, N. Dak. 58103

[21] Appl. No.: 462,876

[22] Filed: Feb. 1, 1983

[51] Int. Cl.[3] ..... A63F 9/14

[52] U.S. Cl. ..... 273/153 R; 273/284

[58] Field of Search ..... 273/153 R, 284

[56] References Cited

U.S. PATENT DOCUMENTS

| | | | |
|---|---|---|---|
| 3,712,617 | 1/1973 | Ohlschlager | 273/153 R |
| 4,004,810 | 1/1977 | Henrie | 273/249 |
| 4,346,889 | 8/1982 | Barlow et al. | 273/153 S |

FOREIGN PATENT DOCUMENTS

| | | | |
|---|---|---|---|
| 42331 | 5/1910 | Austria | 273/153 R |
| 653661 | 12/1962 | Canada | 273/153 R |
| 2359407 | 6/1975 | Fed. Rep. of Germany | 273/153 R |
| 1946 | of 1900 | United Kingdom | 273/153 R |

*Primary Examiner*—Anton O. Oechsle

*Attorney, Agent, or Firm*—James R. Haller

[57] ABSTRACT

A maze game is provided which includes individual pieces that may be placed upon a gameboard, and markers that are moved along grooves formed in the upper surfaces of the individual pieces. The grooves of the individual pieces may be provided with gates extending across the grooves, the gates being pivotable within an intersection of grooves in a manner not determinable in advance by a moving player.

8 Claims, 13 Drawing Figures

MAZE BOARD GAME

FIELD OF THE INVENTION

The invention relates to the field of parlor games.

BACKGROUND OF THE INVENTION

Parlor games of various types have appealed to both adults and children throughout the ages. Games commonly involve elements of chance, as when a gameboard marker is moved in accordance with the show of dice or movement of a spinner or pointer. Many of such games, although easy to learn and initially exciting, rapidly lose appeal as players become bored. Other games, which involve elements of skill as well as of chance, have enjoyed popularity for many years; Monopoly (a trademarked product of Parker Bros.) is an appropriate example; Backgammon is another. Games providing combined elements of skill and chance, hence, are generally preferable to games involving solely elements of chance.

BRIEF DESCRIPTION OF THE INVENTION

The present invention provides a board game in which one player attempts to move a marker through a maze previously arranged by another player. The game includes a board, and means defining a plurality of individual pieces that are placeable on the board. At least a portion of the pieces each have upper surfaces provided with one or more grooves and cooperating, when placed on the board, to define a grooved maze path extending across at least a portion of the board. The game includes marker pieces having portions slideable in the grooves. The individual pieces that are placeable on the board (which may be termed "maze" pieces) and the marker pieces include cooperative retaining means preventing the marker pieces from being lifted from the grooves. Gate means are carried by at least some of the pieces of said portion and extend across their respective grooves and are pivotable in one direction for enabling or blocking the movement of markers in the respective grooves. Means are provided to prevent the player whose marker is to be moved from observing the permitted pivoting direction of the gate means.

DESCRIPTION OF THE PREFERRED EMBODIMENT

Figure 3:
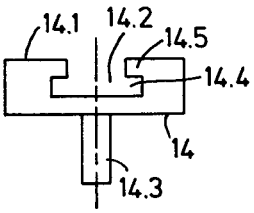
FIG. 3 is a side view of an individual maze piece placeable upon the board of FIG. 2.
Figure 4:
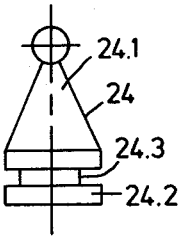
FIG. 4 is a side view of a marker piece.
Figure 2:
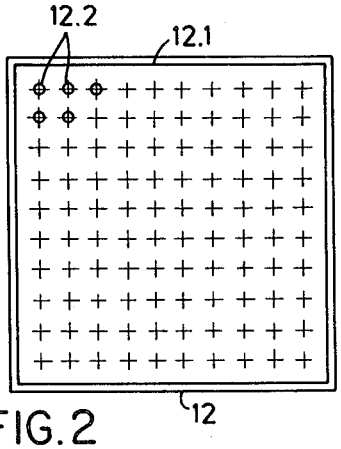
FIG. 2 is a plan view of a board suitable for use in the game of the invention.
Figure 1:
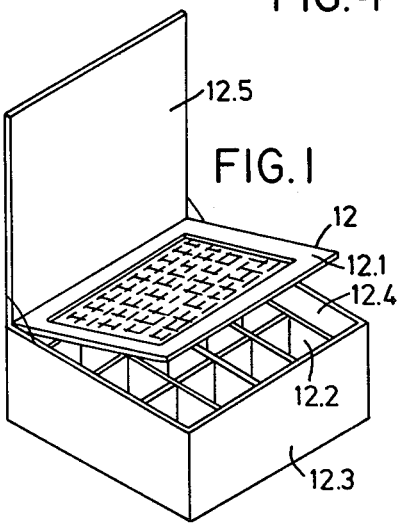
FIG. 1 is a perspective view of a game board of the invention shown together with a box having individual compartments for game pieces.
Figure 5:
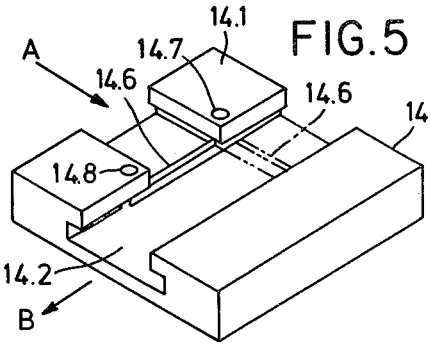
FIG. 5 is a perspective view of an individual maze piece placeable upon the board of FIG. 2.

The board game of the invention consists of three essential elements of which one is an appropriate board designated (12) in FIGS. 1 and 2, the second are individual maze pieces exemplified as (14) in FIGS. 3 and 5 and typified in FIGS. 6–13, inclusive, as pieces 16, 17, 18, 19, 20, 21, 22 and 23, and the third element of which is a marker piece exemplified as (24) in FIG. 4.

The game board (12) is generally rectangular and preferably square, as shown in FIGS. 1 and 2, and desirably includes a raised border (12.1) about its periphery. The board may be provided with columns and rows of holes (12.2) for reception of individual pieces, as will be explained further below. If desired, the board may be hexagonal in shape or may have substantially any other shape that permits the individual pieces (14) to be placed thereon in abutting relationship to one another.

Figure 6:
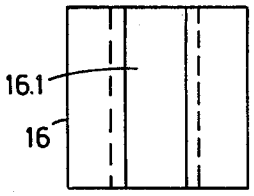
FIGS. 6, 7, 8 and 9 show different individual pieces placeable upon the board of FIG. 2.
Figure 7:
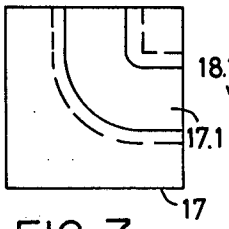
Figure 8:
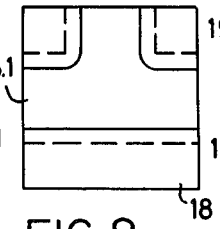
Figure 9:
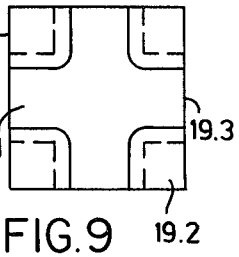

The individual pieces (14) similarly are preferably rectangular, although such pieces may be triangular or of such other regular geometric shape as may enable them to be placed in abutting relationship to one another upon the board (12). Preferably, the individual pieces (14) are square as shown in FIGS. 6–13, inclusive. At least certain of the individual pieces (14) are provided with upper surfaces (14.1) that are grooved in the manner typified at (14.2) in FIGS. 3 and 5, the grooves preferably extending from one or more edges of the pieces (14) to their respective centers. The grooves (14.2) may have a variety of shapes. The groove (16.1) of FIG. 6 extends completely across the piece (16) from one side to the other, whereas the groove (17.1) shown formed in the piece (17) of FIG. 7 extends in a smooth curve from one side of the piece to an adjacent side. The grooves (18.1) and (19.1) shown in FIGS. 8 and 9 are "T"-shaped and cross-shaped, respectively. With reference to a typical embodiment as exemplified in FIG. 9, the grooves (19.1) are generally parallel to the upper surface of the piece, and enter the sides (19.3) of the piece at right angles intermediate the length of the sides.

Each individual maze piece (14) may be provided with a vertically extending post (14.3) (FIG. 3) enabling the piece (14) to be inserted within a hole (12.2) in the game board (12).

The marker piece (24) may have a fanciful upper portion (24.1) and a lower portion (24.2) that is desirably circular in cross-section, the lower portion (24.2) being attached to the upper portion (24.1) by a portion of reduced diameter (24.3). The groove (14.2) formed in the individual maze pieces (14) desirably is undercut as shown at (14.4) in FIG. 3, the lower portion (24.2) of the marker piece being slideable within the undercut portion (14.4) of the individual maze piece (14), and the overhanging edges (14.5) of the maze piece (14) thereby preventing a player from lifting the marker (24) from the piece (14). Various other grooved pathways and markers, such as various dovetail designs, may also be employed.

Figure 10:
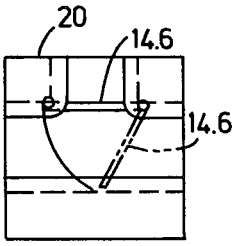
FIGS. 10, 11, 12 and 13 show further individual pieces placeable upon the board of FIG. 2.
Figure 11:
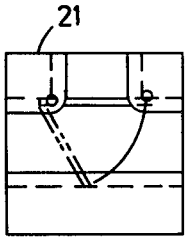
Figure 12:
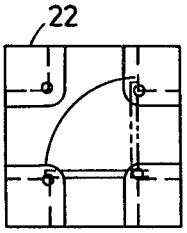
Figure 13:
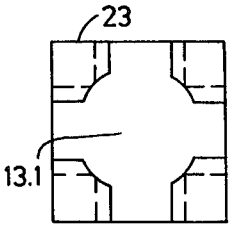

At least certain of the individual maze pieces (14) are provided with gate means, shown best in FIG. 5 and typified by the gate (14.6). The gate (14.6) may be a short length of plastic or other material pivotally mounted by means of a pin (14.7) adjacent an intersection of grooves (14.2) formed in the piece and enabling the gate (14.6) to swing or pivot from the solid line position shown in FIG. 5 to the phantom line position. A similar pivot pin, or at least a simile of an exposed head of a pivot pin, is depicted as (14.8) such that a player normally cannot tell whether the gate will pivot about (14.7) or (14.8). As shown in FIG. 5, a marker piece entering the maze piece (14) in the direction of arrow A will cause the gate (14.6) to move to the phantom line position, whereupon the marker must exit from the piece (14) in the direction of arrow B. The piece (14) of FIG. 5 is also depicted in plan view in FIG. 10, showing the movement of the gate (14.6). Other embodiments of gates are shown in FIGS. 11 and 12, these Figures showing the permitted pivoting or swinging movement of the respective gates. Although the gates will swing open far enough to enable a marker piece to pass by, in the preferred embodiment, the gates will not swing open further than 90°. Further, it will be understood that the opening of the gate to allow passage of a marker in any given individual piece also causes that gate to block off another potential pathway of escape from that piece.

In use, one player, who may for brevity be termed the "Maze Master" removes individual pieces (14) from appropriate compartments (12.2) of the box (12.3) and places these pieces as desired upon the gameboard (12). Desirably, the entire board (12) is filled with maze pieces, the centrally positioned mounting posts (14.3) of the pieces being received within the holes (12.2) of the gameboard and the side edges of the individual pieces abutting one another. Depending to some extent upon the creativeness of the Maze Master, the individual pieces (14) of the various types shown in FIGS. 6–13 are so positioned as to cooperate to form a maze having, desirably, but a single permitted pathway therethrough, the pathway extending across at least a portion of the board. For example, the pathway may extend from the center to a corner of the board, or may extend between corners or sides of the board, all in a manner to be determined for each game by the Maze Master. The gates (14.6) are positioned in their closed orientation as typified in solid lines by (14.6) in FIG. 5. Once the maze has been established, the moving player inserts a marker piece (24) at the position designated by the Maze Master as a "start" position; this position may be determined by the location of an individual piece such as that shown in FIG. 13 which has a large central cutout portion (13.1) enabling a marker (24) to be inserted therein. The moving player then attempts to move his marker through the maze.

As will now be understood, the game lends itself to a variety of playing situations, and rules of marker movement must be established prior to beginning the game. For example, the moving player may be allotted a certain period of time in which to move his marker through the maze from the start to the finish position. The rules may provide that if a gate is touched by a player, he must proceed through the gate if this movement is permitted by the pivoting orientation of the gate. If the pathway thus followed turns out to be a blind pathway, the player may return but may incur a penalty. If the moving player finds a correct path through the maze in the allotted time, he may be awarded a given number of points minus the penalties for following blind paths. If a permitted path through the maze is not found by the moving player within the allotted time, the Maze Master may be required to show the correct path and may be awarded points for so doing. If the Maze Master is not able to recall the correct pathway, he may be penalized points. Players may take turns at being the "Maze Master".

As mentioned above, the game of the invention may include a storage box (12.3) provided with compartments (12.2) for storing the different types of individual pieces (14) and a compartment (12.4) for storing the marker pieces (24). Desirably, the gameboard (12) fits neatly within the box (12.3) as shown in FIG. 1, and a hinged cover (12.5) is provided as a closure for the box and also as a screen to prevent a moving player from seeing the orientation of individual pieces as they are placed on the board by the Maze Master.

While a preferred embodiment of the present invention has been described, it should be understood that various changes, adaptations and modifications may be made therein without departing from the spirit of the invention and the scope of the appended claims.

What is claimed is:

1. A board game in which a player attempts to move a marker through a maze, comprising a board;

means defining a plurality of individual pieces placeable on the board, at least a portion of which pieces have an upper surface provided with one or more grooves and cooperating, when placed on the board, to define a grooved maze path extending across at least a portion of the board;

marker pieces having portions slideable in such grooves;

the individual pieces and marker pieces including cooperative retaining means preventing marker pieces from being lifted from the grooves;

gate means carried by at least some of the pieces of said portion across their respective grooves and pivotable in one direction to enable or block the movement of markers in such grooves, and means preventing observation of the pivoting direction of the gate means.

2. The board game of claim 1 wherein the board is generally rectangular and has a border, and wherein the individual pieces are generally rectangular and sized to fit in abutting relationship in columns and rows within the boarder.

3. The board game of claim 2 wherein the individual pieces are provided with downwardly extending mounting posts and the board is provided with holes positioned to receive the posts.

4. The board game of claim 1 in which said individual pieces have corners and sides extending between the corners, and wherein grooves extend outwardly of such individual pieces at their respective sides and intermediate their respective corners.

5. the board game of claim 1 wherein said grooves are undercut within the individual pieces, and wherein said marker pieces are provided with lower portions slideably received in such undercut grooves.

6. The board game of claim 1 including at least one individual piece placeable upon the board and having a grooved upper surface oriented to permit a marker to be inserted or removed from the groove thereof.

7. The board game of claim 1 wherein said gate means comprises a gate comprising an elongated strut pivotally attached at one end to a corner defined by an intersection of two grooves formed in the individual piece, the strut being of sufficient length to extend substantially across the groove and to block movement of a marker piece along the groove.

8. The board game of claim 7 including a pivot pin pivotally mounting the strut to said corner, and at least one other corner defined by said intersection including means simulating a pivot pin so that a moving player, prior to striking said gate, cannot tell which pin the gate will pivot about.

* * * * *